US006590559B2

(12) United States Patent
Takabayashi et al.

(10) Patent No.: US 6,590,559 B2
(45) **Date of Patent: *Jul. 8, 2003**

(54) LIQUID CRYSTAL DISPLAY

(75) Inventors: Tsutomu Takabayashi, Kumamoto (JP); Masaru Nishimura, Kumamoto (JP); Yasuhiko Kohno, Kumamoto (JP); Hirofumi Shinohara, Kumamoto (JP)

(73) Assignee: Kabushiki Kaisha Advanced Display, Kumamoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,788

(22) Filed: Apr. 20, 1999

(65) Prior Publication Data

US 2002/0067331 A1 Jun. 6, 2002

(30) Foreign Application Priority Data

Apr. 28, 1998 (JP) ..... 10-119657

(51) Int. Cl.[7] ..... G09G 3/36
(52) U.S. Cl. ..... 345/99; 345/204; 345/211
(58) Field of Search ..... 345/98–100, 204–206, 345/211–213, 559, 660; 377/76, 70, 75, 80; 349/149–152

(56) References Cited

U.S. PATENT DOCUMENTS

| | | | | |
|---|---|---|---|---|
| 5,929,925 A | * | 7/1999 | Nakamura et al. | 348/556 |
| 6,072,456 A | * | 6/2000 | Karube et al. | 345/98 |
| 6,320,572 B1 | * | 11/2001 | Takabayashi et al. | 345/204 |
| 6,476,789 B1 | * | 11/2002 | Sakaguchi et al. | 345/100 |

FOREIGN PATENT DOCUMENTS

| | | | | |
|---|---|---|---|---|
| JP | 4-168417 | | 6/1992 | |
| JP | 04168417A Abstr | * | 6/1992 | G02F/1/133 |
| JP | 7-261711 | | 10/1995 | |
| JP | 07261711A Abstr | * | 10/1995 | G09G/3/36 |

OTHER PUBLICATIONS

Patent Abstracts of Japan, Pub. No. 07–261711, Machine Translation of "Detailed Description" Section, Oct. 13, 1995.*

Translation of Japanese Patent JP04168417A.*

* cited by examiner

*Primary Examiner*—Richard Hjerpe
*Assistant Examiner*—Alexander Eisen

(57) ABSTRACT

Wiring between output terminals of a source driver IC (output terminals of a TCP for source driver IC) and picture elements is equalized when number of the picture elements is not an integer multiplied by number of outputs of the source driver IC in the liquid crystal display. By giving a start pulse for indicating a start timing of drive sections to a predetermined drive section at a timing different from an originally set start timing, a part of output terminals of the drive section is made unavailable.

7 Claims, 15 Drawing Sheets

LIQUID CRYSTAL DISPLAY

BACKGROUND AND SUMMARY OF THE INVENTION

1. Industrial Field

The present invention relates to a liquid crystal display for digitally driving a liquid crystal display panel and, more particularly, to a wiring between a drive section and a picture element section.

2. Prior Art

FIG. 11 is a schematic diagram showing a circuit arrangement according to a prior art. Though a plurality of source driver ICs and gate driver ICs are disposed in the liquid crystal display, a circuit signal waveform inputted to an ordinary source driver is shown in FIG. 12. Supposing that the source driver IC has an output of 300 picture element, at the time of display on a display screen, a start pulse outputted from a timing controller disposed in a control section 3 is inputted to a first source driver IC and starts to read data. When reading 1st to 300th data, the first source driver IC outputs a start pulse (shift pulse) to a second source driver IC, and the second driver IC reads the start pulse and reads 301st to 600th data. The second source driver IC outputs a start pulse (shift pulse), whereby a third source driver IC starts to operate. In this manner, a fourth source driver IC, a fifth source driver IC, sixth source driver IC . . . read data in order. After completing the data input covering 1 line to the source driver ICs, an output pulse is inputted to all of the source driver ICs, and picture element voltages corresponding to the data are outputted to picture elements of the liquid crystal panel all at once.

In the meantime, a gate driver IC also starts to operate with a start pulse, and outputs a gate signal in order of output terminals synchronously with a clock signal. When a final output terminal of the gate driver IC outputs, a start pulse (shift pulse) to a next gate driver is outputted, thus a plurality of gate drivers IC come to operate in order.

Generally, as shown in FIG. 14, the signal inputted to the source driver IC has a function of starting a data input, after the start pulse is inputted to the source driver IC, storing temporarily the data in a shift register, and outputting the picture element voltages to a picture element section 2 when an output pulse STB is inputted. Usually, the data stored temporarily in the source driver IC is picture element data covering 1 line.

In the liquid crystal display, a plurality of source driver ICs and gate driver ICs are disposed. For example, supposing that one driver has an output of 300 picture elements as shown in FIG. 15, at the time of display on a display screen, a start pulse STP outputted from the timing controller is inputted to a first source driver IC and starts to read data. When reading 1st to 300th data, a start pulse SFTP1 is outputted to a second source driver IC, and the second driver IC reads the start pulse SFTP1 and reads 301st to 600th data. At the timing of reading the final data (600th data), the second source driver IC outputs a start pulse SFTP2, whereby a third source driver IC starts to operate. In this manner, a fourth source driver IC, a fifth one, a sixth one . . . start to operate in order. After reading the data covering 1 line, the output pulse STB is inputted to each source driver IC all at once, whereby picture element voltages are outputted to the picture elements covering 1 line.

The Japanese Laid-Open Patent Publication (unexamined) Hei 4-168417 and the Japanese Laid-Open Patent Publication (unexamined) Hei 7-261711 disclosed an example according to the prior art, in which a start pulse is inputted to each source driver IC to propose a general purpose source driver IC. In this prior art, however, the output terminals of the source driver IC are made unavailable only at the rear part thereof, and therefore, for example, when the fore part of the output terminal of a TCP (tape carrier package) mounting a source driver IC thereon is not able to be wired to the picture element, this prior art is useless. Just by making unavailable both fore part and rear part of the source driver IC, the wiring from the picture elements to the substrate is more simplified. Moreover, in case of SXGA or UXGA or when number of picture elements are large thereon, number of wires for start pulse outputted from the control section by inputting a start pulse to each source driver IC is largely increased, and wiring on the substrate of the control section becomes difficult.

In the liquid crystal display, picture elements arranged forming a matrix are driven by a plurality of source driver ICs and gate driver ICs. A printed circuit board of the source driver ICs and gate driver ICs is connected to the picture element section 2 supported by a glass substrate 1 through TCP 11. 12. 13 . . . and TCP 21, 22, 23 . . . , otherwise the source driver IC and gate driver IC are directly connected to the picture element section 2 (FIG. 11).

In this case, when number of picture elements is not an integer multiplied by number of outputs in the liquid crystal display, there remains some region where any picture element is not connected to any output terminal of the source driver IC (i.e., output terminal of a TCP for source driver IC). When only the terminal end of the output of the final source driver is not connected, there is no problem even if no action is performed. However, as shown in FIG. 13, when a difference between total number of outputs of the source driver IC and number of picture elements covering one line is large, there arises a large difference in length of lead wires extending from the source driver TCP to the picture element section 2 depending upon regions, and thus there is a possibility of occurring a defective region in display due to resistance of the wires. There is a further disadvantage that distribution of wires may be difficult or sometimes the source driver TCP is oversized protruding out of width of liquid crystal panel, being restricted by a frame size.

SUMMARY OF THE INVENTION

In view of the foregoing, the present invention intends to make unavailable the output of the terminals in the fore part of the first source driver by staggering or delaying a timing when data are read by the source driver IC by, for example, changing a timing of a start pulse inputted to the source driver IC in an amount of appropriate data number. In other words, the output terminals remaining as a result of not connecting the fore part of the output terminals of the first source driver IC to the rear part of the final source driver IC, can be distributed to the fore part and the rear part.

If there is no room in the fore part and the rear part, by adjusting the timing for reading data of the driver IC in the middle part by inputting a start pulse of the driver IC in the middle part from the control section, the fore part and the rear part of the output terminals of the driver IC in the middle part are made unavailable to secure a space, and distribution in wiring from the driver IC to the picture element section is simply equalized.

A clock signal is inputted to each source driver IC, and the clock signal is largely delayed in some region due to load capacity or load resistance of the printed board and source driver ICs. Moreover, it is difficult to forecast the load capacity or load resistance of the printed board and the driver ICs, and amount of delay cannot be forecast. On the other hand, as the start pulse is directly inputted from the control section to the driver IC without passing through any other driver IC, delay of the start pulse is small. Accordingly, it is desired that the start pulse is set and fixed by securing a setup time and a hold time at a predetermined timing in the stage of trial manufacture so that the timing of the start pulse inputted to the source driver IC other than the first source driver IC may be changed by setting it from outside.

Accordingly, a liquid crystal display according to the invention comprises a plurality of drive sections for supplying a display signal to a liquid crystal display section and a control section for controlling the drive sections, in which a start pulse for indicating a start timing of the drive sections is given to a predetermined drive section at a timing different from an originally set start timing, and a part of output terminals of the drive section is made unavailable.

It is preferable that in the liquid crystal display comprising a plurality of drive sections for supplying a display signal to a liquid crystal display section and a control section for controlling the drive sections, a plurality of start pulses for indicating the start timing of the drive sections are outputted from the control section.

It is preferable that by giving the start pulses to a part or all of the drive sections at different timings, either fore part or rear part of the output terminals of the part or all of the drive sections or both fore part and rear part are made unavailable.

It is preferable that the start pulses are given to the plurality of drive sections at different timings, and the timings of giving the start pulses can be changed.

It is preferable that the control section comprises a timing controller having a function for adjusting the start pulse or start pulses and a function for controlling the drive sections.

In the liquid crystal display of above arrangement, lead wires from the driver TCP to the picture element section can be simply wired.

Furthermore, when a blanking interval of a signal for displaying an image inputted from any outside control device to the liquid crystal display is short, number of outputs of the driver IC is adjusted by making unavailable a part of the output terminals of the driver IC by idling the driver IC in the middle part of the liquid crystal display, whereby distribution in wiring can be simply performed, freedom in the arrangement of TCP is enhanced, and the TCP can be simply arranged.

Even when the clock signal inputted to the n-th driver IC distant from the first driver IC is delayed, since the function for adjusting the timing is provided, the clock signal can be set so as to be inputted at a predetermined timing by adjusting the timing even in the stage after having been designed.

Further, circuit arrangement of the control section can be simplified.

Furthermore, by equally distributing the wiring from the TCP to the picture elements, number of manufacturing steps of the wiring pattern used in the manufacturing stage of the liquid crystal panel can be reduced.

Other objects, features and advantages of the invention will become apparent in the course of the following description with reference to the accompanying drawings.

DESCRIPTION OF THE PREFERRED EMBODIMENT

EXAMPLE 1

Figure 1:
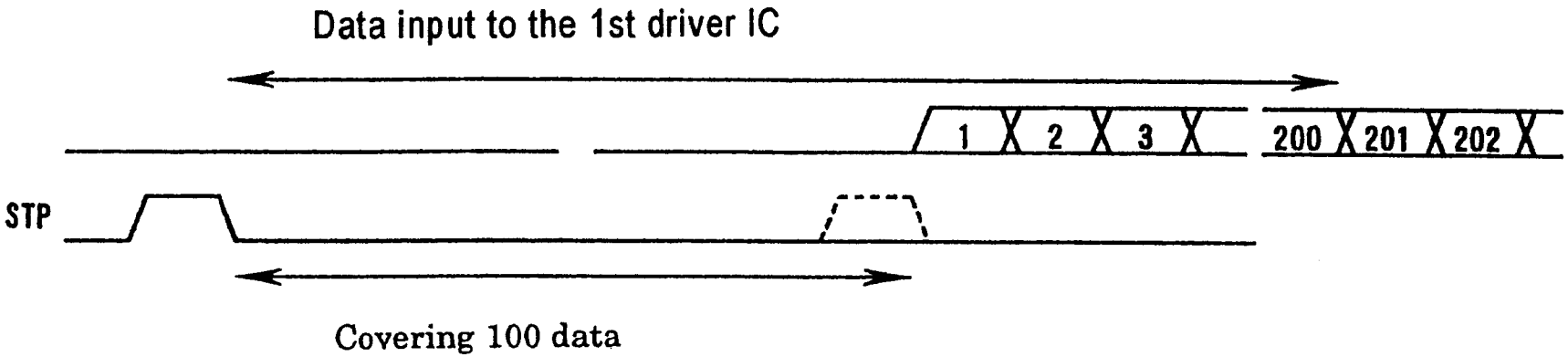
FIG. 1 is a diagram showing a signal waveform according to a first example of the invention.

FIG. 1 is a diagram showing a signal waveform to explain a first example of the invention. Construction and arrangement of the liquid crystal display is same as those of the prior art, and a further description is omitted herein.

Usually, there is a blanking period in liquid crystal display data, and utilizing this period, a timing when a source driver IC reads data is advanced by outputting early a start pulse outputted by the control circuit for controlling the drive circuit. As shown in FIG. 1, the output terminals in the fore part of the first source driver IC being in the blanking period are not connected to picture elements and are made unavailable. At this time, a start pulse STP outputted early counts a period between a pulse of a horizontal synchronizing signal and a leading edge of a DENA signal showing data portion, designates an appropriate timing by means of a counter, and is outputted.

In the above arrangement, the first source driver IC can save the connection from the source driver IC to the picture element by number of output terminals made unavailable in the first source driver IC, and when total number of output pins of the source driver IC is larger than total number of picture elements, wiring from the source driver IC to a picture element electrode can be arranged more equally than that in the prior art.

For example, supposing that there are 300 output terminals in one driver IC and that there are 1000 picture elements in one line of a liquid crystal panel, in case of the prior art, only 100 output terminals in the fore part of the fourth driver IC are used while 101st to 300th terminals are not connected to the picture elements. That is, the 100th terminal of the fourth source driver IC is connected to the 1000th picture element.

Figure 2A:
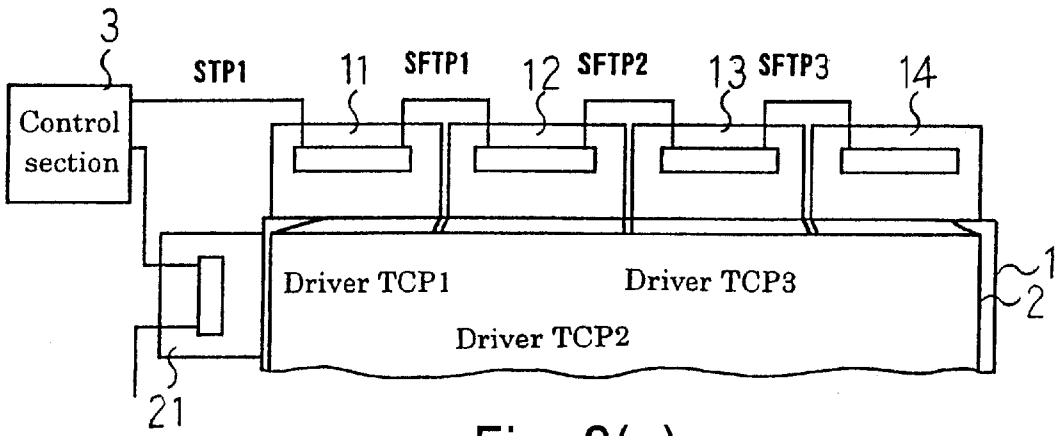
FIG. 2 is a schematic diagram showing the first example of the invention, and in which (a) is a general diagram and (b) is an enlarged diagram of essential part.
Figure 2B:
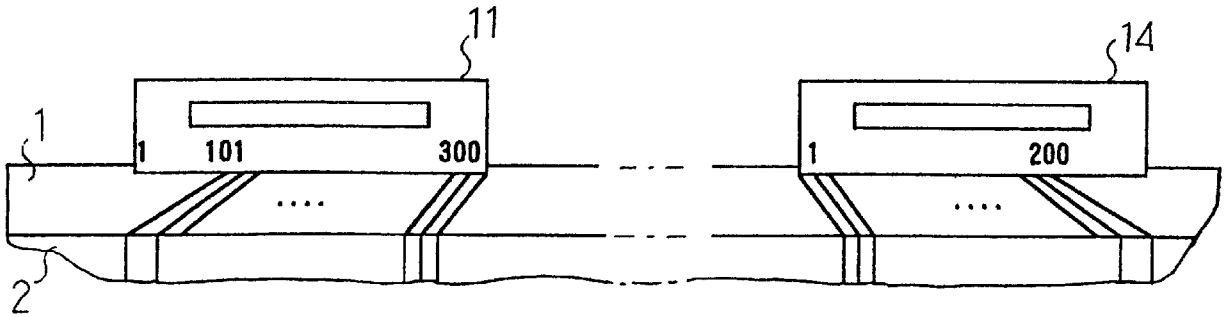

In this example, as shown in FIG. 1, a start pulse STP is inputted to the first driver IC at a point advanced by 100 picture elements. As shown in FIG. 2, the 1st to 100th output terminals of the first driver IC and the 200th to 300th output terminals of the fourth driver IC are refrained from being connected to the picture elements. As the 1st to 100th output terminals of the first driver IC and the 200th to 300th output terminals of the fourth driver IC are in the blanking period of data signal, there is no problem in display if they are not connected to the picture elements.

EXAMPLE 2

Figure 3:
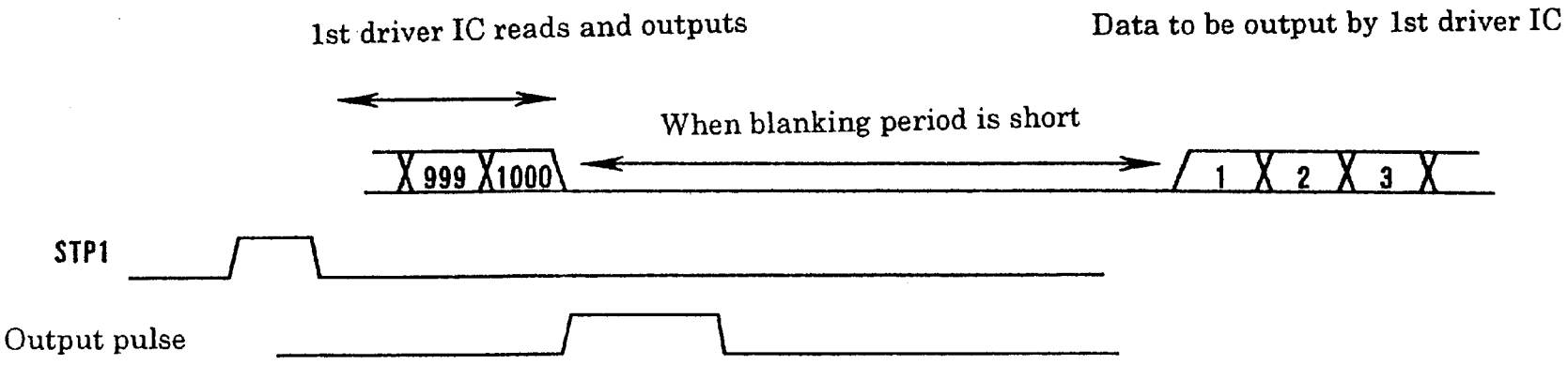
FIG. 3 is a diagram showing a signal waveform according to a second example of the invention.

In the method of inputting early the start pulse of the first driver source described in the foregoing first Example, if the blanking period for inputting to the timing controller is short as shown in FIG. 3, the start pulse STP1 overlaps on the data located 1 line before, and the source driver IC reads data before outputting the data located 1 line before, which is a problem in image display.

To cope with this, when the blanking period for inputting to the timing controller is short, the start pulse outputted from the controller to serve as a control signal of the drive section in the liquid crystal display is outputted to the source driver ICs other than the first driver IC at a predetermined timing, whereby the timing of read by the source diver IC on the way is advanced, and fore and rear parts of the output terminals of the source driver IC located in the middle part are made unavailable so that available output terminals of all source driver ICs are coincident to number of picture elements.

In this case, to secure a setup time and a hold time of the start pulses inputted to the source driver ICs located in the middle part, it is arranged that timing of the start pulses can be switched by set terminals.

Figure 4:
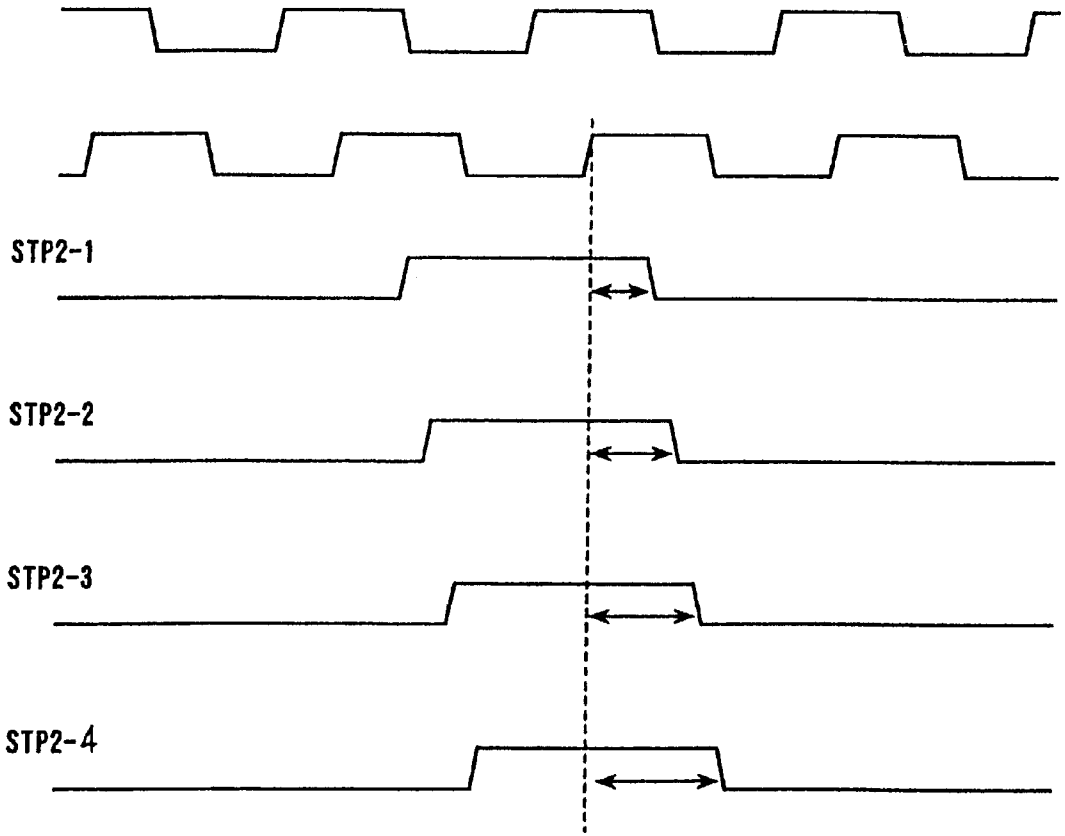
FIG. 4 is a diagram to explain the start pulses according to the second example of the invention.

FIG. 4 shows the setup time and the hold time of the start pulses. In the drawing, STP2-1 is a start pulse of which timing is not adjusted, while STEP 2-2, STP2-3 and STP2-4 are start pulses of which timing is adjusted. As the clock signal tends to delay due to the load capacity of the printed board and each source driver IC, while the start pulse STP2 directly outputted from the control section any does not delay even when outputted synchronously, there is a possibility of not being able to secure the hold time of the start pulse STP2. If the hold time of the STP2-1 is small, the setup time can be secured by switching the timing of the start pulse to any of several stages as indicated by STP2-2 to STP2-4. In the actual use, it is desirable to set to meet standard requirements of setup time and hold time.

Figure 5A:
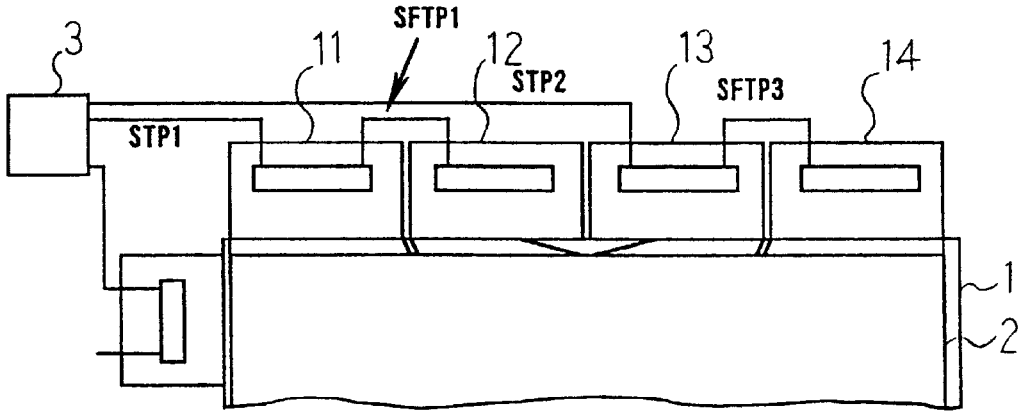
FIG. 5 is a schematic diagram showing the second example of the invention, and in which (a) is a general diagram and (b) is an enlarged diagram of essential part.
Figure 5B:
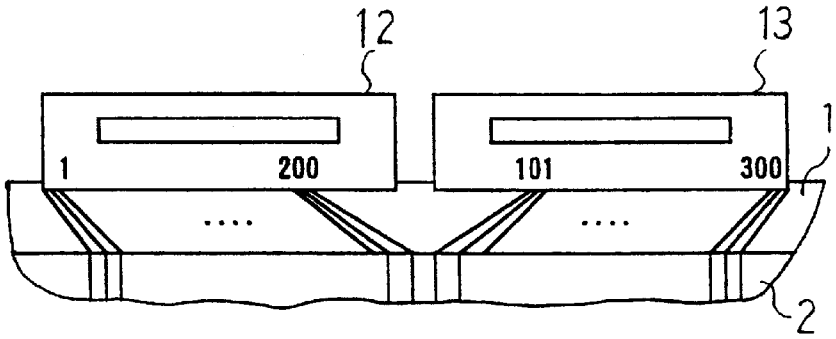
Figure 6:
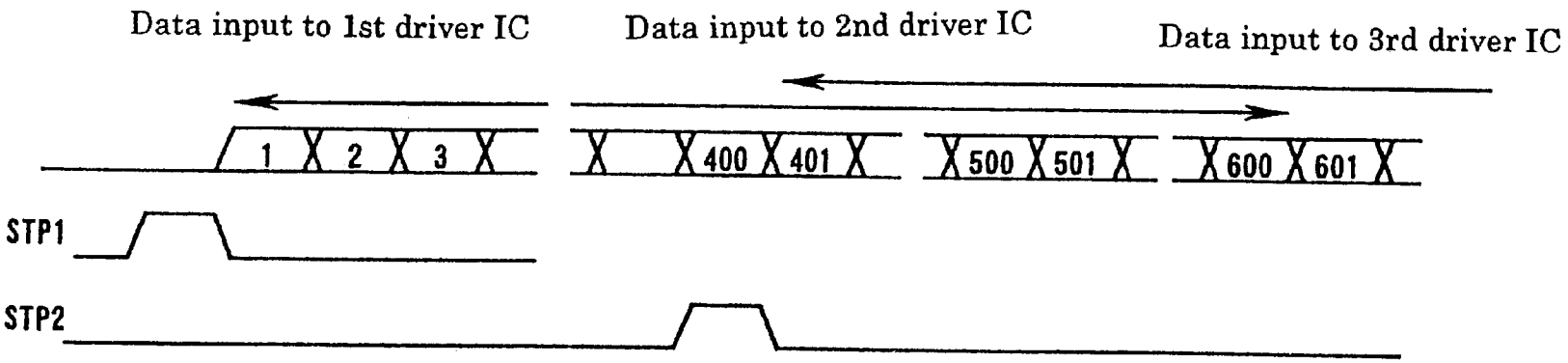
FIG. 6 is a diagram showing a signal waveform according to the second example of the invention.

FIG. 5 shows an arrangement of the source driver ICs, and FIG. 6 is a schematic diagram of inputting the start pulse. Supposing that number of output terminals in one driver IC is 300 and number of picture elements in one line of liquid crystal panel is 1000 in the same manner as in the foregoing Example 1, for example, 201st pin to 300th pin in the rear part of the second output terminal of the source driver IC and 1st pin to 100th pin in the fore part of the third output terminal are made unavailable.

The source driver IC is arranged so that data are read after inputting a start pulse outputted from the control section and that a start pulse is outputted to the subsequent source driver IC at the time of reading the final data, and timing of the start pulse inputted to the first source driver IC is same as in the prior art. The source driver IC starts to read data one after another after inputting the start pulse, and the second start pulse STP2 is outputted from the timing controller to be inputted to the third source driver IC while the second source driver IC is reading. The input timing is synchronized with 400th data among the data outputted from the timing controller. It is preferable that the start pulse STP2 inputted on the way is outputted at a predetermined timing by counting on the basis of last transition of DENA.

It may be said that the output data from the 101st pin to 300th pin of the second source driver IC and those from the 1st pin to 200th pin of the third source driver IC are simultaneously read. For the data read in both second source driver IC and third source driver IC, the output terminals of either source driver IC may be connected to the picture elements. The remaining terminals not connected are left as idling terminals. The start pulse generated from the second source driver IC is refrained from being inputted to the third source driver IC.

Accordingly, distribution of lead wires from TCP tub to picture elements on the glass substrate becomes more simple.

In the above arrangement, since the clock signal is inputted to each source driver IC, the clock signal is delayed depending upon the region due to the load capacity and load resistance of printed board and source driver ICs. On the contrary, as the start pulse is directly inputted from the control section to the source driver ICs without passing through any other source driver IC, delay of the start pulse is small. It is difficult to forecast the load capacity or load resistance of the printed board and the driver IC, and amount of delay cannot be forecast. Accordingly, the start pulse is set and fixed by securing a setup and hold times at a predetermined timing in the stage of trial manufacture so that the timing of the start pulse STP2 inputted to the third source driver IC may be changed by setting it from outside.

Figure 7:
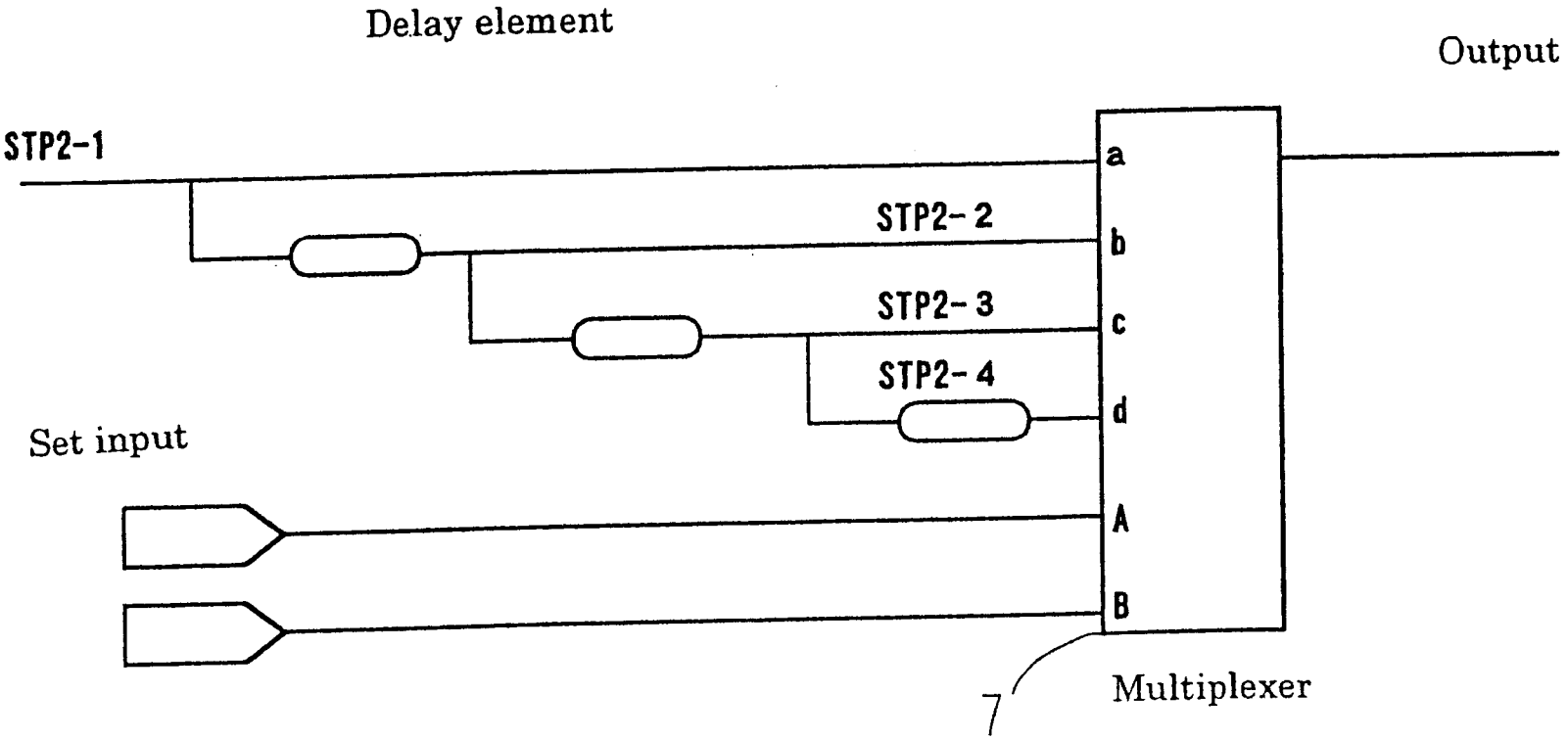
FIG. 7 is a schematic circuit diagram of the control circuit used in the second example of the invention.

A circuit shown in FIG. 7 is disposed to serve as a control circuit. It is established that a multiplexer 7 outputs "a" when (A, B)=(0, 0), "b" when (A, B)=(1, 0), "c" when (A, B)=(0, 1), and "d" when (A, B)=(1, 1). Timing can be delayed by passing the signal through a delay element, and accordingly start pulses of four different timings are generated and an output is selected by the multiplexer 7 in this circuit.

EXAMPLE 3

Figure 8A:
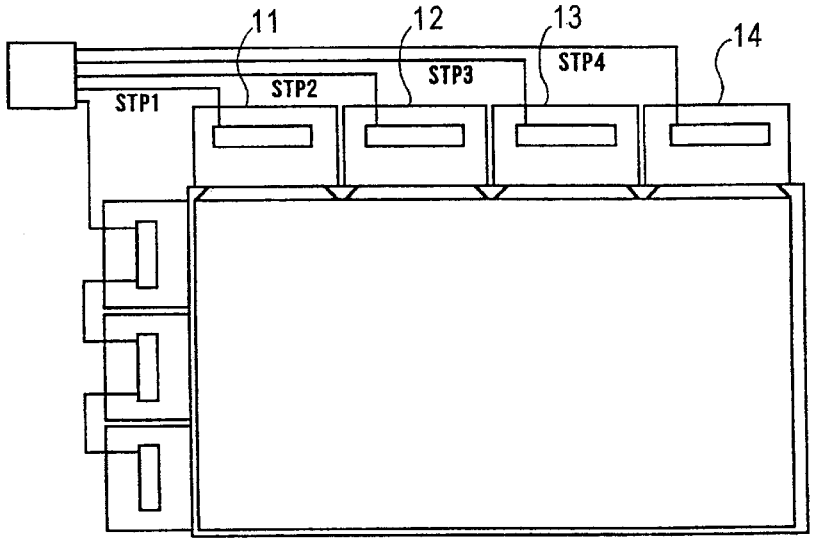
FIG. 8 is a schematic diagram showing a third example of the invention, and in which (a) is a general diagram and (b) is an enlarged diagram of essential part.
Figure 8B:
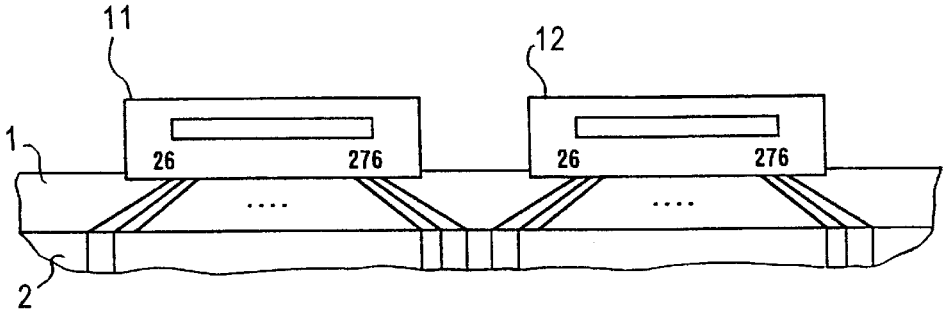

Though only fore and rear parts of the output terminals of the source driver IC located in the middle part is made unavailable in Example 2, fore part and rear part of the output terminals of all source driver ICs can be made unavailable in this Example 3 by inputting a start pulse to each source driver IC. As shown in FIG. 8, by making unavailable the fore part and the rear part of the output terminals of all source driver ICs, the output terminals of all source driver ICs can be distributed equally, and wiring from TCP to the picture elements can be equally arranged.

Figure 9:
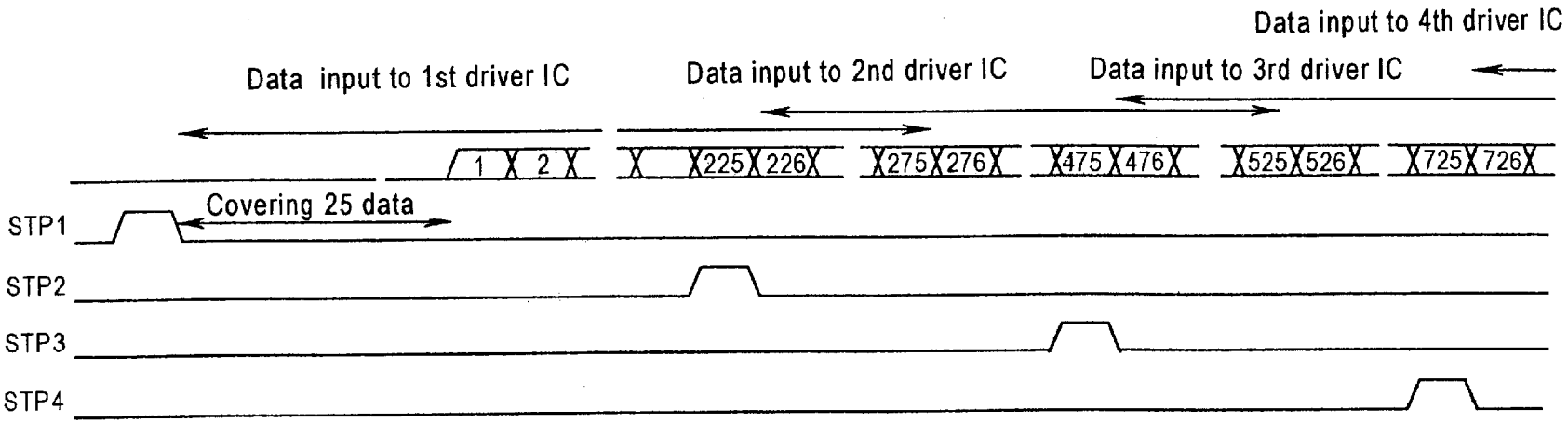
FIG. 9 is a diagram showing a signal waveform according to the third example of the invention.

More specifically, supposing that number of output terminals in one source driver IC is 300 and number of picture elements in one line of liquid crystal panel is 1000 in the same manner as in the foregoing Example 1, with respect to the output timing of the start pulse, only the middle part (26th pin to 275th pin) of the output terminals of each source driver IC is connected to the picture elements, while fore part (1st pin to 25th pin) of the output terminals of each source driver IC and rear part (276th pin to 300th pin) are left not connected to the picture elements, as shown in FIG. 9. As a result of this, wiring from each TCP to the picture elements can be equally arranged.

Though number of pins made unavailable in the fore part of the output terminals of the source driver IC is equal to those of rear part, number of pins made unavailable may be different between the fore part and the rear part and may be decided in conformity with easiness of wiring.

Figure 10A:
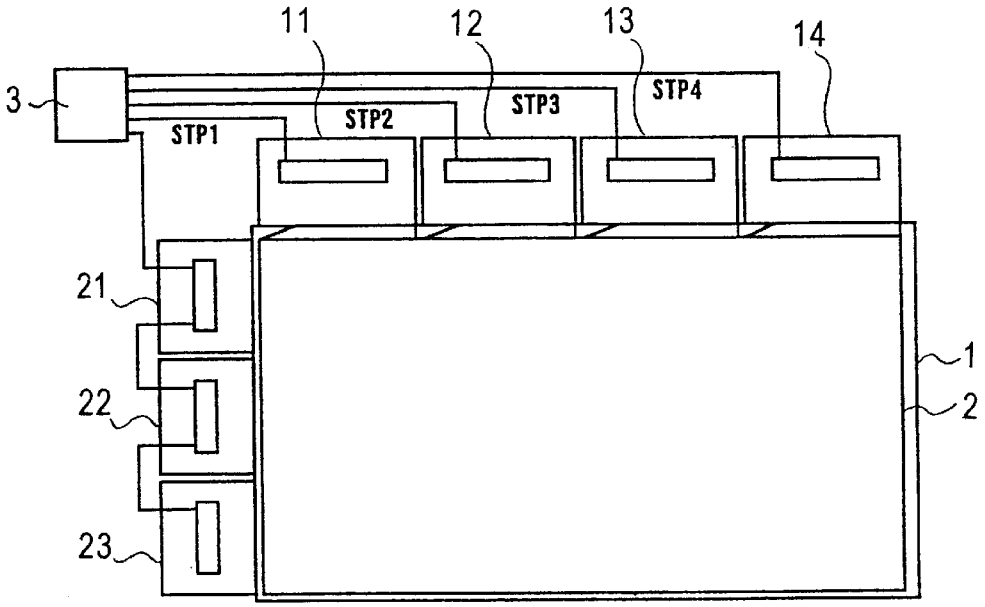
FIG. 10 is a schematic diagram showing the third example of the invention, and in which (a) is a general diagram and (b) is an enlarged diagram of essential part.
Figure 10B:
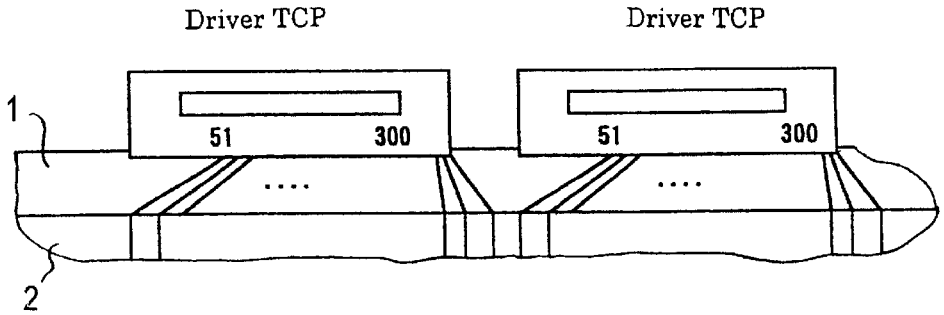
Figure 11A:
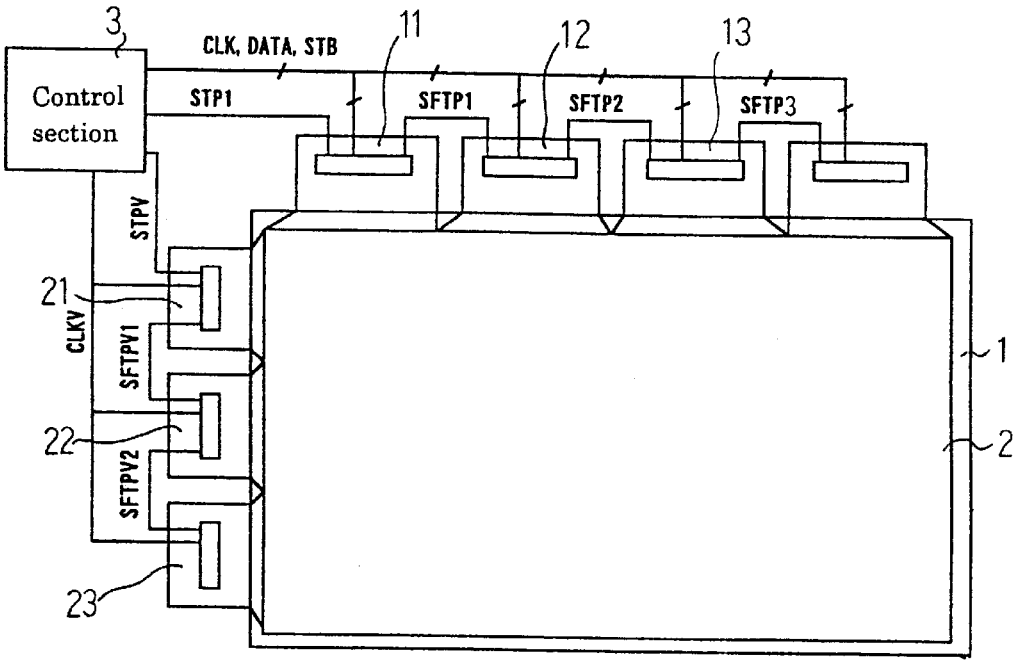
FIG. 11 is a schematic diagram showing a liquid crystal display according to the prior art, and in which (a) is a general diagram and (b) is an enlarged diagram of essential part.
Figure 11B:
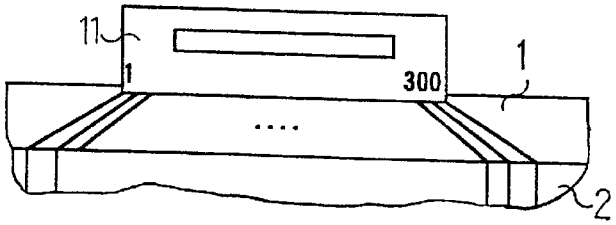
Figure 12:
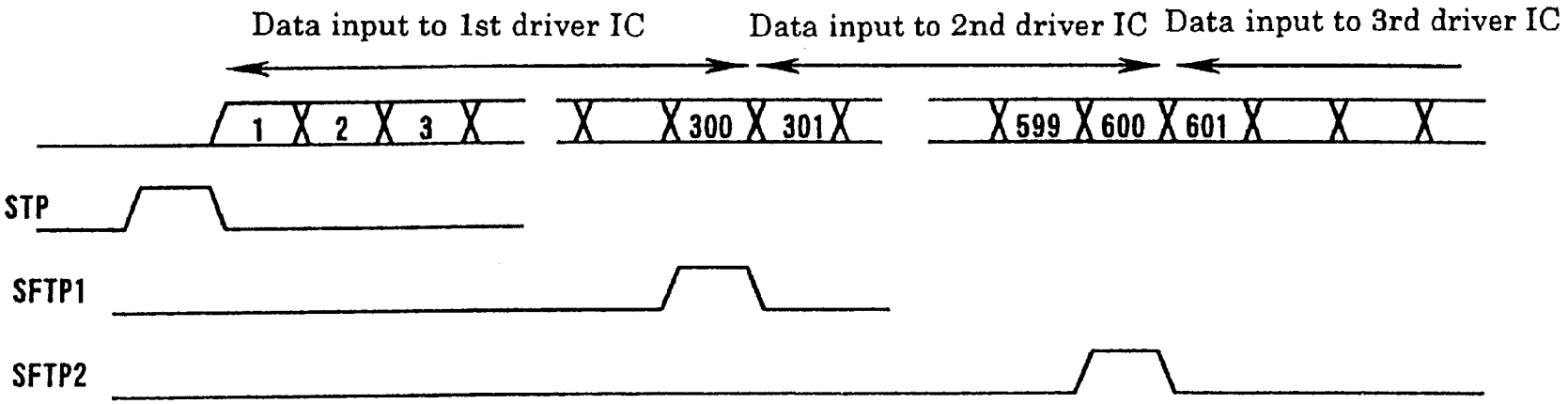
FIG. 12 is a diagram showing a signal waveform of the liquid crystal display according to the prior art.
Figure 13A:
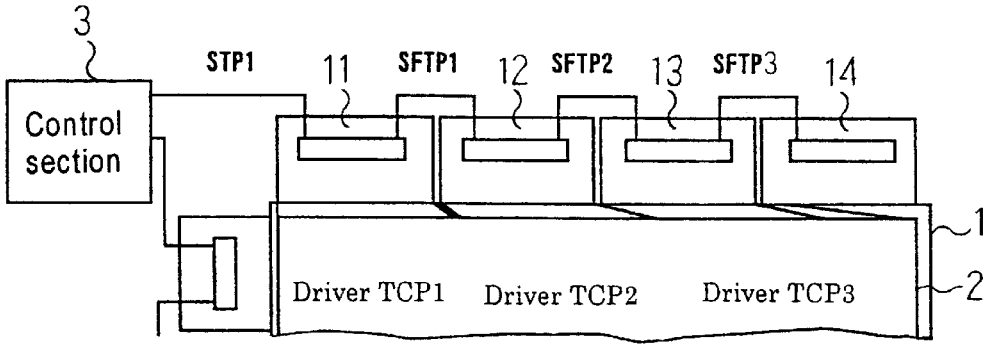
FIG. 13 is a schematic diagram to explain the problems of the liquid crystal display according to the prior art, and in which (a) is a general diagram and (b) is an enlarged diagram of essential part.
Figure 13B:
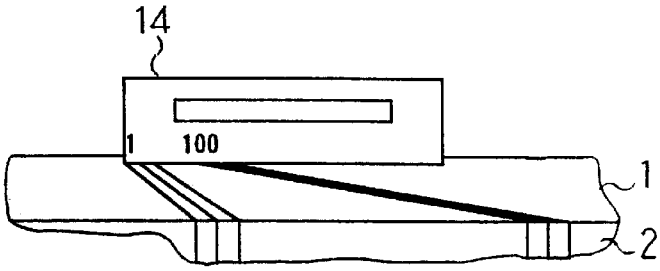
Figure 14:
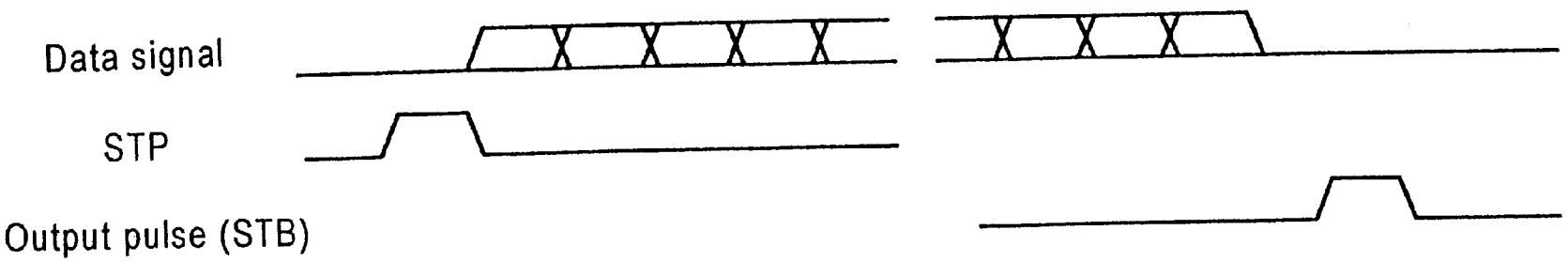
FIG. 14 is a diagram showing a signal waveform of the liquid crystal display according to the prior art.
Figure 15:
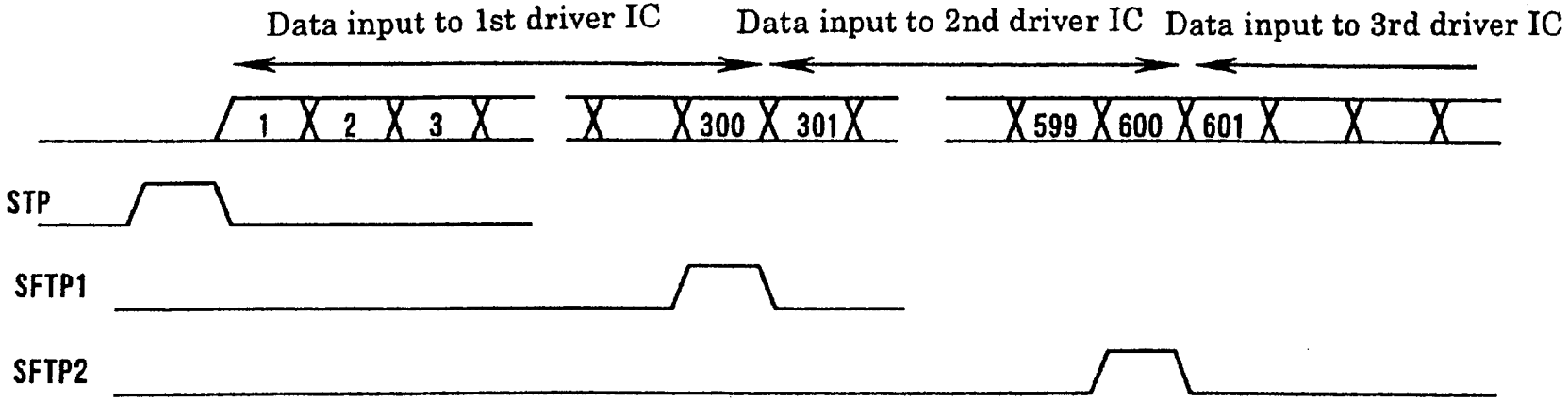
FIG. 15 is a diagram showing a signal waveform of the liquid crystal display according to the prior art.

Further, supposing that number of output terminals in one source driver IC is 300 and number of picture elements in one line of liquid crystal panel is 1000, it is preferable that output timing of the start pulse is adjusted in the same manner as shown in FIG. 9, and the pins made unavailable of the source driver IC are connected to be unequal between the fore part and the rear part, as shown in FIG. 10. That is, without connecting the fore parts (1st pin to 50th pin) of the output terminals of the first source driver IC to the picture elements, the middle part (51st pin to 300th pin) of the remaining output terminals is connected to the picture elements. Likewise, without connecting the fore parts (1st pin to 50th pin) of the output terminals of the second source driver IC and thereafter to the picture elements, the middle part (51st pin to 300th pin) of the remaining output terminals is connected to the picture elements. By such arrangement, wiring from each TCP to the picture elements can be adjusted. It is preferable that selection of one connection method among those connection methods is made based on the connection from the TCP to the picture elements of the substrate, and decided depending upon the arrangement of TCP and easiness in wiring. It is also preferable that number of output terminals made unavailable is changed for each source driver.

Though several preferred arrangements in wiring are described with respect to the source driver IC in each of the foregoing examples, it is possible to make simple the wiring on the gate side by applying the same arrangement to the gate driver IC. It is also possible to enhance the freedom in arrangement of source driver IC, gate driver IC and driver TCP.

Furthermore, the function of adjusting these start pulses can be applied to any conventional arrangement of components without changing their arrangement, by incorporating the function in the timing controller ASIC for controlling the conventional driver IC.

Having described several specific examples of the invention, it is believed obvious that modification and variation of the invention can be made in the light of above teaching.

What is claimed is:

1. A liquid crystal display comprising:

a plurality of drive sections, each drive section containing a plurality of output terminals;

a control section for supplying a first start pulse to an Mth drive section among the plurality of drive sections and a second start pulse to an Nth drive section among the plurality of drive sections, here $N \geqq M+2$, and each of said drive sections supplies a display signal to a corresponding liquid crystal display section; and a plurality of conductors which connect the output terminals of each of the drive sections and carry the display signal to the corresponding liquid crystal display section, wherein the Mth drive section supplies a third start pulse to an (M+1)th drive section and the Nth drive section supplies a fourth start pulse to an (N+1)th drive section, a rear part of the output terminals of the (M+1)th drive section and a fore part of the output terminals of the Nth drive section are both made unavailable, and the length of the conductor adjacent to the rear part of the output terminals of the (M+1)th driver made unavailable and the length of the conductor adjacent to the fore part of the output terminals of the Nth driver section made unavailable are substantially the same.

2. The liquid crystal display claimed in claim 1, wherein the Mth drive section is a first drive section among the plurality of drive sections, and the Nth drive section is a third drive section among the plurality of drive sections.

3. The liquid crystal display claimed, in claim 1, wherein the control section includes a timing controller for adjusting the second start pulse.

4. A liquid crystal display comprising:

a plurality of drive sections, each drive section containing a plurality of output terminals;

a control section for generating a plurality of start pulses at different start timings, each of the drive sections supplies a display signal to a corresponding liquid crystal section, and each of the start pulses is individually supplied to each of the drive sections; and a plurality of conductors which connect the output terminals of each of the drive sections and carry the display signal to the corresponding liquid crystal display section, wherein output terminals in both a fore part and a rear part of each of the drive sections are made unavailable, and the length of each conductor adjacent to the rear part of the output terminals of each driver section made unavailable and the length of each conductor adjacent to the fore part of the output terminals of each driver section made unavailable are substantially the same.

5. The liquid crystal display claimed in claim 4, wherein the control section includes a timing controller for adjusting the start pulses.

6. A liquid crystal display comprising:

a plurality of drive sections, each drive section containing a plurality of output terminals; and a control section which generates a plurality of start pulses for predetermined drive sections of the plurality drive sections, wherein each of the start pulses of the plurality of start pulses for each drive section have a different start timing delayed from a common clock timing, and wherein the control section selects a start pulse to be provided to a drive section based on a setup time and a hold time of start pulses.

7. The liquid crystal display according to claim 6, wherein the control section comprises:

a plurality of delay elements which produce the plurality of start pulses, each start pulse of said plurality of start pulses being delayed from an original start pulse by a predetermined amount, and a multiplexer which provides a selected start pulse from said plurality of start pulses.

* * * * *